US005464096A

United States Patent [19]

Hurwitz

[11] Patent Number: 5,464,096

[45] Date of Patent: Nov. 7, 1995

[54] KIT FOR CLEANING RADIOLOGICAL CASSETTES

[76] Inventor: Robert Hurwitz, 2310 Tustin Ave., Newport Beach, Calif. 92660

[21] Appl. No.: 178,445

[22] Filed: Jan. 7, 1994

Related U.S. Application Data

[63] Continuation of Ser. No. 936,046, Aug. 25, 1992, abandoned.

[51] Int. Cl.[6] ..... B65D 81/22; B08B 1/00

[52] U.S. Cl. ..... 206/494; 15/104.93; 206/812

[58] Field of Search ..... 206/494, 812; 15/104.93, 104.94; 28/105; 250/483.1, 488.1

[56] References Cited

U.S. PATENT DOCUMENTS

| | | | |
|---|---|---|---|
| 3,610,929 | 10/1971 | Fujimoto et al. | 250/488.1 |
| 4,610,357 | 9/1986 | Nakamura | 206/494 X |
| 4,796,751 | 1/1989 | Madkour | 206/494 X |
| 4,983,848 | 1/1991 | Hunter | 250/483.1 |
| 5,111,934 | 5/1992 | Morin | 206/812 X |
| 5,142,752 | 9/1992 | Greenway et al. | 28/105 |

FOREIGN PATENT DOCUMENTS

| | | | |
|---|---|---|---|
| 2914590 | 10/1980 | Germany | 206/812 |

OTHER PUBLICATIONS

OpticPad (The Texwipe Company, Upper Saddle River, N.J. 07458).

BlueWipe (The Texwipe Company, 650 East Crescent Ave., Upper Saddle River, N.J. 07458).

Absorbond, (The Texwipe Company, 650 East Crescent Ave., Upper Saddle River, N.J. 07458).

Kodak Intensifying screen cleaner and antistatic solution (Eastman Kodak Company Rochester, N.Y. 14650).

Cronex Axr Screen Cleaner (E. I. Du Pont de Nemours & Co. (Inc.) Medical Prod. Dept., Wilmington, Del. 19898.

Assessing Wiping Materials for their Potential to Contribute Particles to Clean Environments: A Novel Approach (Swiss Cont. Control 3(1990) No. 4b, 60–65.

Assessing Wiping Materials for Clean Environments, Sep.–Oct. 1991, Journal of the IES, vol. 34, No. 5.

Philosophy and Purpose of the Cleanroom, 9 pages, Steven J. Paley, The Texwipe Company, Oct. 15, 1990.

Physical Data on 30 Mil Polyester Applicator, 1 page, The Texwipe Company.

*Primary Examiner*—Bryon P. Gehman

*Attorney, Agent, or Firm*—Stetina Brunda & Buyan

[57] ABSTRACT

A two-step kit for cleaning an X-ray intensifying screen of a radiological cassette. The kit comprises first and second sealed, air-tight pouches which are fabricated from foil. Disposed within the first pouch is a wet wipe which is formed of a soft, non-abrasive, low particle generating synthetic material which is highly absorbent and pre-saturated with a mild surfactant. Disposed within the second pouch is a dry wipe which is formed of a non-abrasive, low particle generating, non-woven blend of natural and synthetic materials which minimizes streaking and is highly absorbent and resistent to electrostatic charge buildup.

3 Claims, 1 Drawing Sheet

KIT FOR CLEANING RADIOLOGICAL CASSETTES

This is a continuation of copending application Ser. No. 07/936,046 filed on Aug. 25, 1992, now abandoned.

FIELD OF THE INVENTION

The present invention relates generally to radiographic imaging equipment, and more particularly, to a two-step kit for cleaning an X-ray intensifying screen of a radiological cassette.

BACKGROUND OF THE INVENTION

In routine clinical radiology application, X-ray film is housed within a hinged "clam shell" cassette prior to, during and after exposure. The exposed X-ray film is then removed from the cassette in a dark room environment and photographically developed for subsequent reading and interpretation by the radiologist or other practitioner.

The typical radiological cassette comprises a hinged rigid plastic outer shell having two intensifying screens positioned therewith. When inserted into the cassette, the film is sandwiched between the two intensifying screens therewithin so as to allow the emulsion on either side of the film to be exclusively exposed to light from its contiguous screen. The cassette into which the intensifying screens are mounted provides a light-tight container for the X-ray film and also serves to hold the film in tight contact with the screens over its entire surface. The X-ray film is inserted into the cassette in the darkroom with the film subsequently being exposed during a patient exam and then removed for processing. As can be appreciated, careful handling of the cassette prolongs its life which is desirable in that cassettes typically have a minimum cost of approximately $300.

Intensifying screens are used in the cassette since they decrease the X-ray dose to the patient, while still affording a properly exposed X-ray film. Also, the reduction in exposure allows use of short exposure times, which becomes important when it is necessary to minimize patient motion. During X-ray exposure, the intensifying screen functions to absorb the energy in the X-ray beam that has penetrated the patient, and to convert this energy into a light pattern that has substantially the same information as the original X-ray beam. The light then forms a latent image on the X-ray film. As will be recognized, the transfer of information from the X-ray beam to the screen light to the film results in some loss of the information. Though in the prior art there are X-ray cassettes which incorporate only a single intensifying screen, the inclusion of two intensifying screens in the X-ray cassette allows either side of the X-ray film sandwiched therebetween to be exposed.

Each intensifying screen disposed in the X-ray cassette typically includes four layers and has a total thickness of about 15 or 16 mils. The base or screen support is generally made of a high-grade cardboard or of a polyester plastic, having a thickness of 7–10 mils. Applied to one planar surface of the base is a reflecting coat which is made of a white substance, such as titanium dioxide ($TiO_2$), which is spread over the base in a thin layer of approximately 1 mil thickness. Though some screens do not have a reflecting layer, such a reflecting layer is usually incorporated into the screen. Since many light photons are directed toward the back of the screen, i.e. toward the base layer, and would be lost as far as photographic activity is concerned, the reflecting layer acts to reflect light back toward the front of the screen.

Applied directly over the reflecting coat or the base (if no reflecting coat is included) is a phosphor layer containing phosphor crystals. The crystals are suspended in a plastic (polymer) containing a substance to keep the plastic flexible. The thickness of the phosphor layer is typically about 4 mils for par speed screens with the thickness being increased 1 or 2 mils in high speed screens and being decreased slightly in detail screens. Finally, applied over the phosphor layer is a protective layer which is made of a plastic, largely composed of a cellulose compound that is mixed with other polymers. The layer is generally about 0.7 to 0.8 mils thick and is often made of methylcellulose. The protective layer generally serves three functions, i.e. to prevent static electricity, to give physical protection to the delicate phosphor layer, and to provide a surface that can be cleaned without damaging the phosphor layer.

One of the difficulties associated with cassette technology is the constant exposure of the upper-most layer of the intensifying screen, i.e. the protective methylcellulose layer (routinely called the "screen"), to dust and particulate contaminants in the dark room. Static charges which form over the surface of the intensifying screen may cause dust, lint or other particulate matter to stick to the intensifying screen and to cause the appearance of artifactual images on the X-ray.

As can be appreciated, the intensifying screens and particularly the protective layer, must be kept clean in that any foreign material on the screen, such as paper, blood, dust, lint or static charges will block light photons and produce an area of underexposure on the X-ray film (typically referred to as "artifacts") corresponding to the size and shape of the soiled area. Though the cleaning of the protective layer reduces or eliminates the "artifacts" thereon, such cleanings are a major source of "screen" wear. Since quality assurance is becoming an essential feature of radiography, the particular shadows of the various screen "artifacts" previously described are no longer accepted when they appear on the final film. Should an "artifact" be seen and the "screen" recleaned, the patient must be re-exposed to the X-ray which causes both a delay in the patient care and an unnecessary increase in the total X-ray dose to the patient.

Though maintaining the cleanliness of the screen is desirable, as previously specified, the repeated cleaning of the "screen" wears down the protective layer and shortens its life. In this respect, the primary cause of screen failure is mechanical attrition. Under normal conditions of use, X-ray photons will not damage the screen, though such damage frequently occurs on the basis of continued cleanings. For many years, major manufacturers of X-ray cassettes have sold products referred to as "intensifying screen cleaners" which are typically provided in squirt bottle dispensers that contain an anti-static compound and a detergent. The instructions accompanying at least one of these cleaners generally recommend that the cleaning solution be applied to the surface of the screen with a gauze pad. However, the current use of gauze pads in relation to cleaning screens gives rise to undesirable effects in that the woven surface of the pad is made to absorb and not to clean. The frequent use of a gauze pad for this purpose may cause undue wear or erosion of the intensifying screen surface. Additionally, visible streaking occurs when a fluid is wiped over a polymer surface using such a pad. The woven, cotton gauze may further create lint such lint being a major cause of subsequent screen artifacts appearing on X-ray films. Finally, the abrasive nature of the gauze pad shortens the screen life. In addition to the aforementioned shortcomings, the gauze pads are typically expensive in that they are often packaged as individual sterile items in individual paper pouches. A clean gauze pad is required for screen cleaning, but sterility is an unnecessary expense. Further, the tearing open of the paper pack may in itself, create dust, which such dust may result in screen artifacts on the subsequent X-ray exposure.

As previously indicated, the protective layer of the intensifying screen must be cleaned on a daily basis to minimize lint, particulate matter, dust and static electricity since each of these elements, in addition to paper, can create artifacts on the final film product. The sterile gauze wipes currently utilized to clean the screens are an unexpected source of particulate contamination and static electricity, and also contribute to mechanical wear of the screen. Thus, the need to frequently rewash the screens actually shortens screen life. The present invention overcomes these and other deficiencies associated with prior art screen cleaning methods by providing a kit for cleaning an X-ray intensifying screen which does not create screen artifacts and does not promote screen wear.

SUMMARY OF THE INVENTION

In accordance with a preferred embodiment of the present invention, there is provided a two-step kit for cleaning an X-ray intensifying screen of a radiological cassette. The kit generally comprises first and second sealed, air-tight pouches which are preferably fabricated from foil and attached to each other via a perforation. Disposed within the first pouch is a wet wipe which is formed of a soft, non-abrasive, low particle generating material which is both highly absorbent and pre-saturated with a mild surfactant. In the preferred embodiment, the wet wipe comprises 100% hydroentangled polyester which is saturated with a surfactant comprising sodium alkylrarylpolyethoxysulfonate at a concentration of approximately 0.6% (w/w) and from 0.8% to 1.2% phosphoric acid. Additionally, the wet wipe is preferably sized so as to allow a constant amount of the surfactant to be applied to the screen.

Disposed within the second pouch is a dry wipe which is formed of a non-abrasive, low particle generating non-woven blend of natural and synthetic materials which minimizes streaking and is both highly absorbent and resistant to electrostatic charge buildup. The dry wipe preferably comprises a non-woven blend of approximately 55% cellulose and approximately 45% polyester, and preferably contains a blue substrate color to indicate exposure to liquids.

The present invention further comprises a method for cleaning an X-ray intensifying screen of a radiological cassette comprising the steps of opening a first sealed, air-tight pouch and removing a wet wipe therefrom, wherein the wet wipe is formed of a soft, non-abrasive, low particle generating, synthetic material which is both highly absorbent and pre-saturated with a mild surfactant. Once the wet wipe is removed from the first pouch, the screen is wiped therewith. Thereafter, a second pouch is opened and a dry wipe removed therefrom which is formed of a non-abrasive, low particle generating, non-woven blend of natural and synthetic materials which minimizes streaking and is both highly absorbent and resistant to electrostatic charge buildup. After removing the dry wipe from the second pouch, the screen is wiped therewith to remove any residual surfactant therefrom. Advantageously, the construction of both the wet and dry wipes and composition of the surfactant cleans the screen by eliminating artifacts therefrom and further reduces the exposure of the screen to additional artifacts as well as wear and damage to the screen as often occurs through the utilization of other abrasive wiping materials.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Figure 1:
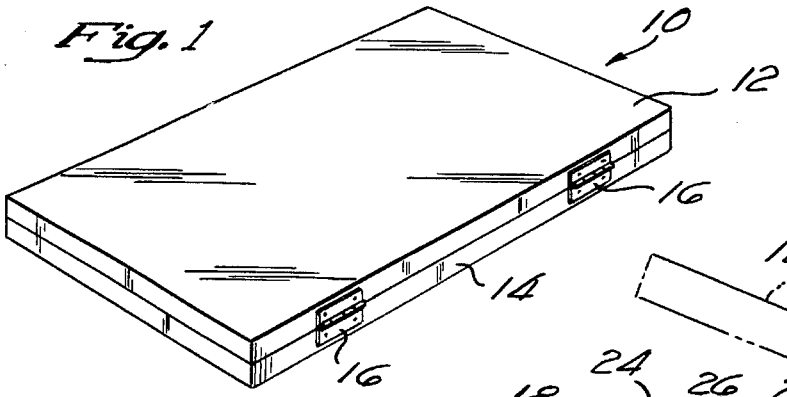
FIG. 1 is a perspective view of a prior art X-ray film cassette.

Referring now to the drawings wherein the showings are for purposes of illustrating a preferred embodiment of the present invention only, and not for purposes of limiting the same, FIG. 1 perspectively illustrates a conventional prior art X-ray film cassette 10. The cassette 10 typically has a rectangular configuration and comprises an outer light-tight hinged container including an upper section 12 and a lower section 14 which are pivotally connected to each other via a pair of hinges 16.

Figure 1A:
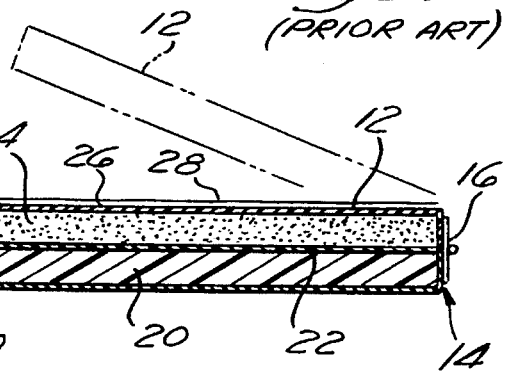
Fig. 1a (PRIOR ART)
FIG. 1*a* is a cross-sectional view taken along line 1—1 of FIG. 1 illustrating the layers comprising an intensifying screen disposed within the cassette.

Referring now to FIG. 1*a*, disposed in the lower section 14 is a first intensifying screen 18. In accordance with a typical prior art construction, the intensifying screen 18 consists of four layers. The first layer is the screen support or base 20 which is made of a high-grade cardboard or of a polyester plastic. The base 20 generally has a thickness of approximately 7–10 mils. Spread over the base 20 in a thin layer of approximately 1 mil thickness is a reflecting layer 22 which is made of a white substance, such as titanium dioxide ($TiO_2$). During the X-ray exposure, light produced by the interaction of X-ray photons and phosphor crystals (which will hereinafter be described) is emitted in all directions. Though much of the light is emitted from the screen in the direction of the X-ray film within the cassette 10, many light photons, are also directed toward the back of the screen, i.e. toward the base 20, and would be lost as far as photographic activity is concerned. As such the reflecting layer 22 acts to reflect light back toward the front of the screen 18. It will be recognized that in certain intensifying screens, a reflecting layer is not included.

Applied over the reflecting layer 22, or directly over the base 20 if a reflecting layer 22 is not included, is a phosphor layer 24 containing phosphor crystals. The crystals are suspended in a plastic (polymer) containing a substance to keep the plastic flexible. The thickness of the phosphor layer 24 is generally about 4 mils for medium speed screens, with the thickness being increased 1 or 2 mils in high speed screens and decreased slightly in detail screens. Applied over the phosphor layer 24 is a protective layer 26 which is made of a plastic, largely composed of a cellulose compound that is mixed with other polymers. The protective layer 26 is typically formed of methylcellulose and is generally applied in a thickness of about 0.7 to 0.8 mils. The protective layer 26, which is typically referred to as the "screen", generally serves three specific functions which are to prevent static electricity, give physical protection to the delicate phosphor layer 24, and to provide a surface that can be cleaned without damaging the phosphor layer 24.

As seen in FIG. 1*a*, the intensifying screen 18 is disposed within the lower section 14 in a manner wherein the protective layer 26 defines the exposed surface of the screen 18. In utilizing the cassette 10, the upper section 12 is pivoted upwardly away from the lower section 14, and a piece of X-ray film 28 placed upon the surface of the protective layer 26. Thereafter, the upper section 12 is pivoted downwardly toward the lower section 14 in a manner sandwiching the film 28 between the lower section 14 and upper section 12. Though certain X-ray cassettes include only a single intensifying screen, the cassette 10 includes a pair of intensifying screens 18 disposed therein. In this respect, a second intensifying screen 18 is disposed in the upper section 12 in the same manner the intensifying screen 18 is disposed within the lower section 14. As such, when the cassette 10 is closed, the X-ray film 28 will be sandwiched between the protective layers 26 of each of the intensifying screens 18 disposed within the upper and lower sections 12, The film 28 disposed within the cassette 10 includes a photosensitive emulsion on both sides. Thus, when the film 28 is sandwiched between the pair of intensifying screens 18, either side may be directly exposed to the X-rays. Each of the intensifying screens 18 within the cassette 10 function to absorb the energy in the X-ray beam that has penetrated the patient, and to convert this energy into a light pattern that has substantially the same information as the original X-ray beam. The light then forms a latent image on the X-ray film 28. In utilizing the X-ray cassette 10, the X-ray film 28 is loaded thereinto in the dark room. The film 28 is then exposed during a patient exam, and subsequently removed from within the cassette 10 for processing. As will be recognized, maintaining the protective layers 26 of each intensifying screen 18 free from particulate contamination and static electricity is extremely important to prevent the formation of particulate shadows on the exposed X-ray film 28.

Figure 2:
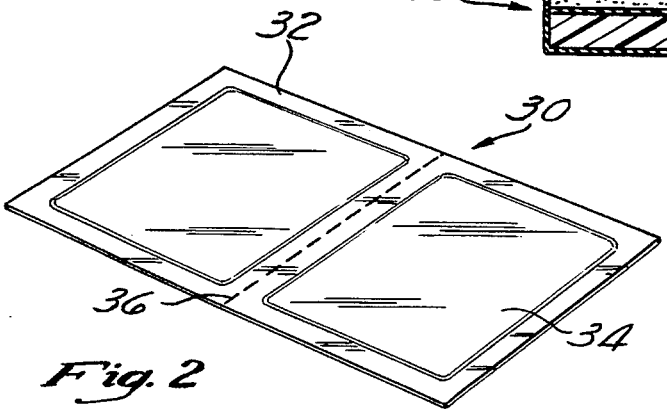
FIG. 2 is a perspective view of the screen cleaning kit constructed in accordance with the present invention.

Referring now to FIG. 2, perspectively illustrated is a kit 30 for cleaning the protective layers 26 of the intensifying screens 18 disposed within the radiological cassette 10. The kit 30 generally comprises a first sealed, air-tight pouch 32 and a second sealed, air-tight pouch 34. In the preferred embodiment, the first pouch 32 and second pouch 34 are each fabricated from foil, though other materials may be utilized as an alternative. Additionally, the first pouch 32 is preferably attached to the second pouch 34 by a perforation 36, though it will be recognized that the first and second pouches 32, 34 may be provided in a separated orientation.

Figure 3:
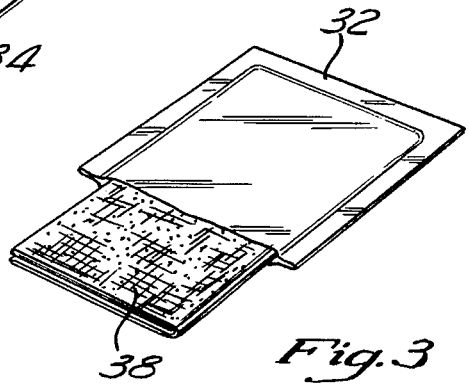
FIG. 3 is a perspective view illustrating one of the two pouches of the cleaning kit as opened to remove a wipe therefrom.
Figure 4:
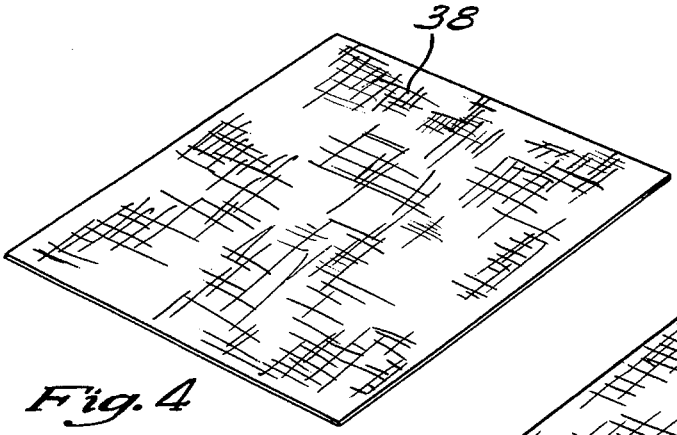
FIG. 4 is a perspective view of a wet wipe used in the cleaning kit of the present invention.

Referring now to FIG. 4, disposed within the first pouch is a wet wipe 38. When the first pouch 38 is opened (in the manner shown in FIG. 3), the wet wipe 38 is removed from therewithin and used to wipe the protective layer 26 of one or both of the intensifying screen 18 within the cassette 10. The wet wipe 38 is formed of a soft, non-abrasive, low particle generating synthetic material which is highly absorbent and pre-saturated with a mild surfactant for purposes of cleaning the protective layer 26. In the preferred embodiment, the wet wipe 38 comprises 100% hydroentangled polyester. Advantageously, the hydroentanglement process uses jets of water to mechanically entangle the fibers, thus eliminating the need for chemical binders. The sorptive capacity of the wet wipe 38 is approximately six times its weight which is due to the density of the fiber structure thereof which allows for the sorption of liquids through capillary action. The hydroentangled polyester of the wet wipe 38 is preferably made from the ABSORBOND™ material manufactured by the Texwipe Company, 650 East Crescent Avenue, Upper Saddle River, N.J. 07458.

The wet wipe 38 is preferably sized so as to allow a constant amount of the surfactant to be applied to the protective layer 26 of the screen 18. The surfactant with which the wet wipe 38 is pre-saturated preferably comprises sodium alkylrarylpolyethoxysulfonate at a concentration of approximately 0.6% (w/w). The surfactant further comprises from 0.8% to 1.2% phosphoric acid. As seen in FIG. 3, the wet wipe 38 is provided within the first pouch 32 in a folded configuration. Additionally, the wet wipe 38 is removed from within the first pouch 32 by tearing the same which is easily accomplished due to the foil construction of the first pouch 32.

Figure 5:
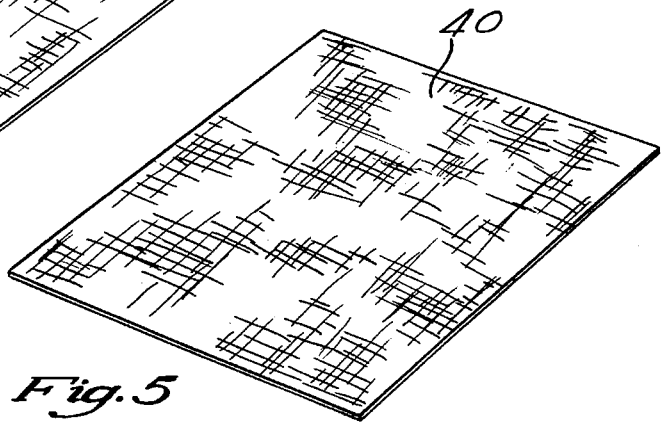
FIG. 5 is a perspective view of a dry wipe used in the cleaning kit of the present invention.

Referring now to FIG. 5, disposed within the second pouch 34 is a dry wipe 40. After the protective layer 26 of the screen 18 has been wiped with the wet wipe 38, the second pouch 34 is torn open in the same manner shown in FIG. 3, and the dry wipe 40 removed from therewithin to wipe the protective layer 26. Advantageously, due to the foil construction of both the first and second pouches 32, 34, the tearing open of the same to remove the wet wipe 38 and dry wipe 40 from therewithin does not create dust as does the tearing of paper and thus, does not create additionally screen artifacts on the subsequent exposure of the X-ray film 28. Additionally, though the wet wipe 38 and dry wipe 40 are sealed in their respective pouches 32, 34, they are not sterilized, thus reducing the overall cost associated with the kit 30.

The dry wipe 40 is formed of a non-abrasive, low particle generating, non-woven blend of natural and synthetic materials which minimize the streaking of the residual surfactant and is highly absorbent and resistant to electrostatic charge buildup. In the preferred embodiment, the dry wipe 40 comprises a non-woven blend of approximately 55% cellulose and approximately 45% polyester. The cellulose and polyester blend of the dry wipe 40 offers both durability and absorbency. Additionally, the dry wipe 40 preferably contains a blue substrate color to indicate exposure thereof to liquids. In the present invention, the dry wipe is fabricated from the BLUEWIPE™ material manufactured by the Texwipe Company, 650 East Crescent Avenue, Upper Saddle River, N.J. 07458. Though the wet wipe 38 and dry wipe 40 have been described as being manufactured from specific brands of materials, it will be recognized that other materials possessing the aforementioned properties may be utilized as an alternative. Additionally, though not shown, when disposed within the second pouch 34, the dry wipe 40 is also in a folded configuration.

In utilizing the kit 30 of the present invention, initially the first pouch 32 is torn open in the aforementioned manner, and the wet wipe 38 removed from therewithin. Thereafter, the protective layer 26 of one or both of the intensifying screens 18 within the cassette 10 is wiped utilizing the wet wipe 38. Due to the pre-saturation of the wet wipe 38 with the surfactant, the wet wipe is operable to clean the surface of the protective layer 26 and remove any particulate contamination as well as static charge buildup therefrom. Advantageously, due to the non-abrasive and low particle generating construction of the wet wipe 38, the protective layer 26 is not contaminated with additional particulates from the wet wipe 38, nor is it degraded due to any abrasive qualities of the wet wipe 38.

After the wiping of the protective layer 26 with the wet wipe has been completed, the wet wipe 38 is discarded and the second pouch 34 torn open to remove the dry wipe 40 from therewithin. As previously specified, the tearing open of both the first and second pouches 32, 34 does not create additional particulate material due to the foil construction of the same. After the dry wipe 40 is removed from within the second pouch 34, the protective layer 26 is wiped therewith to remove any residual surfactant therefrom. Due to the blue tint of the dry wipe 40, a quick visual indication is provided as to whether the dry wipe 40 has been exposed to any surfactant. Advantageously, due to the non-abrasive, low particle generating construction of the dry wipe 40, additional particulate contaminates are not placed upon the protective layer 26, nor is the protective layer 26 subjected to any abrasive qualities. Further, the high absorbency of the dry wipe 40 removes any residual surfactant and further eliminates electrostatic charge buildup due to its construction.

Additional modifications and improvements of the present invention may also be apparent to those skilled in the art. Thus, the particular combination of parts described and illustrated herein is intended to represent only one embodiment of the invention, and is not intended to limit the scope of the claims which follow, or the overall spirit and scope of the intervention, as disclosed herein.

What is claimed is:

1. A kit for cleaning the intensifying screen of a radiological cassette with minimal generation of static charge and minimal deposition of particles on said intensifying screen, said kit comprising:

a first air-tight pouch containing a first sheet of hydroentangled polyester fiber moistened with a mild surfactant comprising approximately 0.6% (w/w) sodium alkylarylpolyethoxysulfonate in 0.8% to 1.2% phosphoric acid; and a second air-tight pouch containing a second sheet of dry non-particle generating non-woven natural and synthetic materials for drying said intensifying screen.

2. The kit of claim 1 wherein said second sheet further comprises a non-woven blend of approximately 58% cellulose and approximately 45% polyester.

3. The kit of claim 1 wherein said second sheet contains a substrate color which will darken when said second sheet becomes saturated with liquid.

* * * * *